US005478514A

United States Patent [19]

Hamilton

[11] Patent Number: 5,478,514

[45] Date of Patent: Dec. 26, 1995

[54] PROCESS FOR MAKING ELASTIC STRETCH WOVEN FABRIC

[75] Inventor: Cathy J. Hamilton, Wilmington, Del.

[73] Assignee: E. I. Du Pont de Nemours and Company, Wilmington, Del.

[21] Appl. No.: 339,168

[22] Filed: Nov. 10, 1994

[51] Int. Cl.[6] ..... D02G 3/02

[52] U.S. Cl. ..... 264/103; 28/155; 57/3; 57/11; 264/288.4; 264/340; 264/345

[58] Field of Search ..... 264/103, 174, 264/288.4, 290.2, 340, 345; 28/155; 57/3, 11, 225

[56] References Cited

U.S. PATENT DOCUMENTS 3,357,076 12/1967 Greenwald et al. ..... 428/230

4,467,595 8/1984 Kramers ..... 57/225

4,554,121 11/1985 Kramers ..... 264/103

OTHER PUBLICATIONS

Lycra® Spandex Fiber Bulletin L-94, "Producing Stretch-Woven Fabrics from Core-Spun Yarns containing Lycra® Spandex" E. I. du Pont de Nemours & Co. (Apr. 1980).

*Primary Examiner*—Leo B. Tentoni

[57] ABSTRACT

An improved process is provided for weaving an elastic stretch fabric. The fabric is woven with weft and/or warp yarns that are combination yarns which comprise a partially oriented synthetic crystalline polymer yarn combined with an elastomeric core. The fabric is then stretched, heat set and finished under particular conditions to provide the resultant fabric with an elastic stretch of 18 to 45% and dimensions about equal to the as-woven dimensions.

4 Claims, No Drawings

PROCESS FOR MAKING ELASTIC STRETCH WOVEN FABRIC

BACKGROUND OF THE INVENTION

1. Field of the Invention

This invention relates to a process for making an elastic stretch woven fabric and the product made thereby. More particularly, the invention concerns an improvement in such a process and product. The improvement involves the fabric being woven with a combination yarn that comprises an elastomeric yarn and a companion yarn of partially oriented non-elastomeric polymer.

2. Description of the Prior Art

Processes are known for making stretch-woven fabrics. For example, Lycra® spandex Fiber Bulletin L-94, "Producing stretch-woven fabrics from core-spun yarns containing LYCRA® spandex fiber," E. I. du Pont de Nemours & Co. (April 1980) describes the fabric design and construction, weaving, heat-setting and dyeing and finishing of filling-stretch, warp-stretch and two-way stretch woven fabrics. A core-spun yarn is a combination yarn that is produced by spinning a sheath of "hard" fibers (i.e., conventionally drawn, oriented non-elastomeric fibers, filaments or strands) around a core of elastomeric strand while the elastomeric strand (e.g., spandex) is under tension and elongated to several times its relaxed length. Subsequent release of the tension and contraction of the elastomeric core strand yields a stretchable combination yarn. Other processes for making stretchable combination yarns are known wherein elastomeric strand is combined with hard fibers, for example, by covering, air-jet entangling, plaiting and the like. However, woven stretch fabrics made with such combination yarns, typically have much smaller dimensions than the length and width of the loom on which the fabrics were woven.

Greenwald et al, U.S. Pat. No. 3,357,076, discloses processes in which woven stretch fabrics are made with another kind of elastic combination yarn. The combination yarn of Greenwald et al is produced by wrapping undrawn synthetic filamentary material around a non-extended, non-heat set, elastomeric core strand. The woven fabric is stretched to draw the undrawn filamentary wrapping of the combination yarn. Then, the stretched fabric is at least partially relaxed and heat set in the partially relaxed state. Stretch fabrics made by the process of Greenwald et al are stated to exhibit a variety of surface effects and a stretch in the range of 10% to 215%.

The one example of Greenwald et al describes a fabric woven to a 45-inch (114-cm) width, stretched at 220° F. (104° C.) and subsequently treated in three different ways, as follows. In part (1) of the Example, the woven fabric, after having been stretched to a 55-inch (140-cm) width, was relaxed to a 43-inch (109-cm) width and then heat set at 380° F. (193° C.) in the relaxed condition. The resultant fabric was described as a terry-face fabric having a potential stretch of 40%. In part (2) of the Example, the fabric after having been stretched to a 110-inch (279-cm) width, was relaxed to a 48-inch (122-cm) width and then heat set at 380° F. (193° C.) in the relaxed condition to yield a terry-face fabric having a 215% potential stretch. In part (3) of the Example, after having been stretched to a 110-inch (279-cm) width, the woven fabric was not relaxed but was heat set at 380° F. (193° C.) while fully stretched at the 110-inch (279-cm) width to yield a fabric having a knit-deknit appearance and a potential stretch of less than 10%.

The present inventor found that the fabrics of Greenwald et al have certain short-comings. When fabrics such as those produced in parts (1) and (2) of the Greenwald et al Example were further treated under typical finishing conditions of hot-wet dyeing and scouring at or near a temperature of 100° C., the fabrics shrank considerably and lost most of their potential stretch. With regard to part (3) of the Greenwald et al Example, hot-wet finishing of the heat-set fabric did not improve the inadequate potential stretch of the fabric. In addition, the properties of undrawn fibers, which are required for the filamentary wrapping of the elastic combination yarn of the Greenwald et al process, change significantly when stored for different lengths of time. Such changes in the undrawn fibers often make it very difficult to produce yarns and fabrics with consistent properties and lead to inferior woven fabrics.

In view of the above-noted shortcomings of the known processes for making stretch woven fabrics, an object of the present invention is to provide an improved process and a stretch woven fabric therefrom that will overcome or ameliorate at least some of the shortcomings.

SUMMARY OF THE INVENTION

The present invention provides an improved process for preparing a stretch woven fabric. The process is of the type that includes the steps of weaving a fabric with warp yarns and weft yarns, at least the warp yarns or the weft yarns being combination yarns which comprise an elastomeric strand and a non-elastomeric companion yarn, and then stretching, heat setting, and finishing the woven fabric. The improvement comprises the non-elastomeric companion yarn being of partially molecularly oriented synthetic organic polymer, preferably polyester or nylon, and the elastomeric strand having a heat setting temperature that is higher than the heat setting temperature of the non-elastomeric companion yarn, stretching the woven fabric by 25 to 85%, preferably by 30 to 60%, in the direction of at least the warp combination yarns or the weft combination yarns, heat treating the stretched woven fabric, while in the stretched condition, for 30 to 90 seconds, preferably 45 to 60 seconds, at a temperature in the range of 80° to 180° C., preferably at least 120° C., said temperature being below the heat setting temperature of the elastomeric strand, and finishing the heat-treated fabric in an aqueous bath for at least ½ hour at temperature that is at or near the boiling point of the bath, but at a temperature of no higher than 135° C.

The invention also provides an improved stretch woven fabric made by the process just described and wherein the companion yarns typically exhibit a repeating pattern of light and dark sections along their length when subjected to the oriented-in-fabric dyeing test (described hereinafter).

DETAILED DESCRIPTION OF PREFERRED EMBODIMENTS

The following detailed descriptions illustrate preferred embodiments of the invention. The descriptions are not intended to limit the scope of the invention. The scope is defined by the appended claims.

In describing the invention, various terms are used. As used herein, the term "combination yarn" means a yarn in which there are dissimilar component yarns, in this case, an elastomeric yarn and a non-elastomeric companion yarn. "Fiber" includes in its meaning staple fibers and continuous filaments. "Partially molecularly oriented" fiber refers to a fiber of synthetic organic crystalline polymer that has substantial molecular orientation but is not fully drawn and can achieve further molecular orientation. Partially oriented fiber yarns suitable for use in the present invention, sometimes referred to herein as "POY", typically have break elongations in the range of 50 to 150%. "Undrawn fiber" means a fiber that is not drawn, has only a very small amount of molecular orientation and has a break elongation of greater than 150%, typically greater than 200%. In contrast, fully drawn conventional synthetic organic crystalline fiber generally has a break elongation in the range of 15 to 35%. The "weft" is the widthwise yarns of a woven fabric and is often referred to in the art as the "filling", "fill" or "woof". Similarly, the "warp" is the lengthwise yarns of a woven fabric and is sometimes referred to in the art as the "ends". The term "spandex" means fiber of a long chain synthetic polymer that comprises at least 85% by weight segmented polyurethane. The term "heat set temperature" refers to the temperature at which the woven fabric of the invention, after having been stretched, is heat treated, for no more than 90 seconds, to stabilize the dimensions of the companion yarn. After stretching and heat setting the companion yarn has a break elongation to less than 50%. The "heat set temperature" of the elastomeric yarn is the lowest temperature at which the elastomeric yarn, when held at that temperature under tension in an extended state for 90 seconds, experiences a permanent reduction in denier and an inability to recover its original length upon release of the tension.

The process for preparing a woven stretch fabric in accordance with the present invention includes steps that are known and can be performed in conventional equipment. However, to obtain the advantageous stretch woven fabrics of the invention, the process requires particular starting materials, a specific order of performing the steps and particular conditions for treating the woven fabric.

In the first step of the improved process of the invention, a fabric is woven with warp yarns and weft yarns. The warp yarn and/or the weft yarn comprises a combination yarn having an elastomeric yarn (or strand), preferably of spandex, and a companion yarn (or strand). The companion yarn is of non-elastomeric synthetic organic polymeric fibers that are partially molecularly oriented. Polyester or nylon polymers are preferred for the partially oriented polymeric fibers. The elastomeric yarn of the combination yarn has a heat setting temperature that is higher than the heat setting temperature of the companion strand.

Combination yarns for use in accordance with the process of the invention can be prepared by various known techniques. The partially molecularly oriented synthetic organic polymer fiber of the companion strand can be combined with the elastomeric yarn of by operations such as wrapping, covering, core spinning, air-jet intermingling, air-jet entangling, plaiting and the like. For use in the present invention, the elastomeric yarn typically can amount to 2 to 40%, preferably 4 to 10%, of the total weight of the combination yarn.

Suitable materials for the elastomeric yarn include spandex, rubber, thermoplastic polyurethanes, polyetheresters and the like. However, each of these elastic yarn materials must have a higher heat setting temperature than that of the companion yarn with which it is combined. Spandex (e.g., LYCRA® spandex fiber, sold by E. I. du Pont de Nemours & Co.) which typically has a break elongation in the range of 250 to 800% and a heat setting temperature in the range of 365° to 400° F. (185°–204° C.) is a preferred elastomeric yarn.

Typical synthetic organic polymers suitable for the companion strand of the combination yarns include 66-nylon, 6-nylon, polyethylene terephthalate, polybutylene terephthalate, cationic dyeable polyester and the like. The companion strand typically has a heat setting temperature that is in the range of 120° to 180° C., preferably 140° to 180° C.

The heat setting temperature of the elastomeric yarn is typically at least 5° C., preferably at least 10° C., higher than that of the non-elastomeric synthetic organic companion yarn.

In preparing the combination yarns suitable for use in the present invention, the spandex or other elastomeric yarn is usually extended by no more than 100% during the combining operation. Typically, the extension is in the range of about 20 to 70%.

Various weave patterns are suitable for preparing elastic woven fabrics according to the invention. Preferred fabrics are woven so that the warp is predominantly on one face of the fabric and the weft predominantly on the other face. Twills (e.g., 1×2, 1×3, herringbone, etc.) are particularly preferred. A plain weave is suitable when a fabric having a crepe effect is desired. When the elastic combination yarn is used only in the weft, the warp can be composed of substantially any other yarn, such as cotton, nylon, polyester, wool, rayon, acrylic, etc. Similarly, when the elastic combination yarn is used only in the warp, the weft can be composed of substantially any other yarn. The invention is particularly useful in preparing stretch denim fabrics.

For satisfactory performance in apparel in which the woven stretch fabric of the invention is incorporated, the fabric has an elastic stretch in the range of 18 to 45%, preferably 20 to 35%

In the stretching step of the process of the invention, the woven fabric is stretched in the direction of the combination yarn by 20 to 50% (i.e., to 1.2 to 1.5 times its original dimension). For example, when the combination yarns are used only in the weft, the stretch can be applied in a tenter frame across the width of the woven fabric (i.e., the weft direction). Similarly, when the combination yarns are only in the warp direction, the stretching of the fabric can be applied by a series of draw rolls. When the combination yarns are employed in both the warp and the weft, a conventional hi-axial stretching apparatus can be employed. The stretching of the fabric in this manner draws the partially oriented synthetic organic polymeric fibers of the companion yarn in the combination yarn. The orienting effect of the stretch on the companion yarn can be demonstrated by comparing the decitex or birefingence of companion yarn samples removed from the combination yarn before and after the stretching step. When fabrics are stretched in accordance with the present process, the companion yarn can undergo a reduction in decitex of as much as 30% with an accompanying increase in birefringence. Another convenient method for determining that a partially oriented yarn was molecularly oriented further during stretching of a woven fabric of the invention is provided the "oriented-in-fabric dyeing test" described hereinafter. The stretching step may be performed with the woven fabric wet or dry.

In accordance the invention, the stretched woven fabric is heat set while the fabric is in the stretched condition. During heat setting, the stretched fabric is subjected for 30 to 90 seconds to a temperature in the range of 120° to 180 ° C., but below the heat setting temperature of the elastomeric core of the combination yarn. Preferably, the stretched woven fabric is heat set for 40 to 80 seconds at a temperature of at least 140° C. Heat-setting can be performed with the stretched woven fabric wet or dry.

If desired, the stretching and heating can be performed simultaneously, with the stretching being applied as the fabric temperature is raised. Usually, when the fabric is hot, less force is needed to stretch the fabric. Alternatively, the stretching and heat-setting can be performed in two or more stages. Stretching can be done in a first stage and heat-setting in a second stage, or some of the heating can be done during stretching to reduce the forces required and then the temperature can be raised further to heat-set the fabric. When the combination yarn used in weaving the fabric has a partially oriented polyester companion yarn, a higher temperature is needed in the last stage of a multistage drawing procedure than in the first stage because the polyester fibers "remember" the highest temperature to which they were exposed. Accordingly, if the temperature in the last stage were cooler than in an earlier stage, the polyester yarn would shrink to the dimensions under which it was stretched in the earlier stage. In contrast, to satisfactorily use companion yarns of partially oriented 6-nylon or 6,6-nylon in the process of the invention, one must maintain tension on the fabric until the heat setting is complete; otherwise, unwanted shrinkage of the POY would occur upon premature release of the tension.

The last step in the process of the invention is a finishing step which comprises releasing the fabric from any substantial tension and immersing the fabric for ½ to 1 hour in an aqueous bath maintained at a temperature close to or at the atmospheric boiling temperature of the bath, or at a temperature no higher than 135° C. when the bath is under pressure (e.g., when dyeing a fabric containing polyester fibers). In the finishing step, various operations can be performed, such as aqueous scouring, dyeing, rinsing and the like. During finishing, the fabric develops its final dimensions and stretch characteristics.

Woven stretch fabrics prepared by the process of the invention typically have a built-in stretch capability in the range of 18 to 45%, preferably in the range of 20 to 35%, and final fabric dimensions that are about the same as the original dimensions of the fabric as woven on the loom.

Test Procedures

In the preceding description of the invention and in the examples below, various characteristics are mentioned. Unless indicated otherwise, these characteristics were determined by the following procedures.

An Instron Tester equipped with flat rubber-faced pneumatic grips is employed to determine the tensile properties of the yarns. Break tenacity, T, and break elongation, E, of non-elastomeric yarns are measured according to test method ASTM D 2256. The break elongation of elastomeric yarns (e.g., spandex) is measured according to the general procedures of test method ASTM D 2731-72. For the elastomeric yarns, a 2-inch (5-cm) gauge length and a zero-to-300%-to zero elongation cycle is used. The samples are cycled five times at a constant elongation rate of 800% per minute. After the fifth cycle the sample is elongated at the same rate to break.

Fabric stretch also is measured with an Instron Tester. A 4-inch (10.2-cm) long, 1-inch (2.54-cm) wide sample is clamped with a 2-inch (5.08-cm) spacing between the clamps. An extension of 50% per minute is applied until a load of 2 lb (0.9 Kg) is reached. At the 2-lb load, the sample length, L, is measured in inches and the % fabric stretch, % S, is calculated by the formula, % S=100(L- 2)/2.

To confirm that partially oriented fibers were used for the companion yarn of the combination yarn with which a fabric was woven, an "oriented-in-fabric dyeing test" is used. The following description is with regard to a fabric in which the companion yarn is of nylon 66 polymer. Straightforward substitution of the appropriate dyes, additives and conditions by one of ordinary skill in the art readily makes the test applicable to other synthetic crystalline polymeric fibers as well (e.g., polyester). The woven fabric is subjected to a 15-minute scour at 140° F. (60° C.) in an aqueous bath containing 0.1 gram/liter of MERPOL® HCS, surface active agent (a nonionic liquid detergent sold by E. I. du Pont de Nemours & Co.) and 0.1 g/l of ammonia. The fabric is then rinsed thoroughly with clear water. The rinsed fabric is placed in an aqueous bath operating at 80° F. (27° C.) and containing 5 g/l of monosodium phosphate and maintained at a pH of 5.0 with phosphoric acid. Based on the weight of the fabric, 1 weight % of Polar Brilliant Blue RAWL dye (sold by Ciba-Geigy Corp. ) is added to the bath, the temperature of the bath is raised to 100° C. and the fabric is immersed in the bath for 30 minutes to become dyed. Thereafter, a sample of the combination yarn is removed from the fabric. Strands of the nylon companion yarn are teased from the combination yarn. The teased strand samples are examined under 10X magnification. A repeating pattern of light and dark sections are seen along the length of the nylon strand. The pattern corresponds to the repeating pattern of crossings of the warp and weft of the woven fabric and indicates that the companion yarn originally was a partially oriented yarn.

EXAMPLES

In the following Examples, samples of the invention are designated with arabic numerals; comparison samples are designated with upper case letters. Each of the results reported in the Examples are from single measurements. The measurements are believed to be provide representative values, but do not constitute the results of all the runs and tests performed involving the indicated yarns, fibers and components.

The following examples illustrate the invention with the preparation of woven twill fabrics. The wefts of the fabrics were combination yarns that had POY companion yarns (i.e., companion yarns of partially oriented crystalline polymer) around an elastomeric core of 40-den (44-dtex) LYCRA® spandex fiber, Type 146C (sold by E. I. du Pont de Nemours & Co.). The specific POY yarn that was used is described in each example below, just before the tabulated summary of results of the stretching and heat setting tests that were performed on each sample. Unless noted otherwise, each of the companion yarn was a commercial POY yarn sold by E. I. du Pont de Nemours & Co.

In preparing the combination yarn, the spandex was extended by 50% and combined with the POY companion yarn on a Leesona #512 twister (Leesona, Inc. Warwick, RI) operating at a linear speed of about 92 yd/min (84 m/min) and inserting about 3.5 turns per inch (1.38/cm) of twist into the combination yarn.

Each fabric sample was woven on a C-4 loom, (sold by Crompton & Knowles, Worcester, Ma.) with 2916 warp ends of 6.4/1 CC, 830-denier (922-dtex) 100% cotton yarn, spaced at 55 warp ends/inch (21.6/cm), and 48 picks per inch (18.9/cm) of combination weft yarns, to produce 1×3 warp-faced twill fabric.

Except in Example 5, as noted below, the stretching and heat treating of the woven fabrics were performed on a Bi-axis Lab Stretcher (sold by T. M. Long Co. of Somerville, N.J.). The stretcher has a chamber which is equipped with (a) a vacuum mounting device for holding a fabric sample in place, (b) alligator clamps for grasping and stretching the sample and (c) means for heating the chamber. For each test, a 5.5-inches (14.0-cm) long by 4-inches (10.2-cm) wide fabric sample was cut, with the combination yarn in the long direction (i.e., weft or fill direction) of the sample. A 3-inch (7.6-cm) gauge length was marked in the center of the long direction of the fabric for use in determining the actual stretch imposed on the fabric. A square piece of cardboard measuring 4 inches (10.7 cm) long on each side was centered in the middle of the fabric so that an extra 0.75 inch (1.9 cm) of fabric extended beyond each end of the cardboard. The extending edges of the fabric were folded over the edges of the cardboard. The sample was then subjected to following sequence. The fabric/cardboard combination was placed onto the vacuum mounting apparatus with the fabric side up; vacuum was applied to hold the test sample in place; the apparatus positioned the thusly mounted sample within the opened alligator clamps in the pre-heated chamber; the clamps were activated to grasp the fabric/cardboard on all four sides; the vacuum mounting apparatus was disengaged and moved away; the chamber was closed and reheated for one minute to the desired operating temperature; the sample was then stretched a pre-set amount in the long direction of the sample at 100% per minute (i.e., in the direction of the combination yarn of the sample); the clamps and chamber were then opened; the sample fabric was removed from the chamber; and the sample was then allowed to cool to room temperature while in a relaxed condition. Note that the cardboard always broke during the early stages of sample stretching. Fabrics that were to be stretched and heat set while wet were first soaked for 5 to 15 minutes in room-temperature tap water before being subjected to stretching and heating sequence. In this apparatus, some slippage of the fabric can occur in the stretcher clamps. Also some fabric shrinkage can occur during cooling of the fabric under relaxed conditions. In Example 5, fabric was stretched and heated a large tenter frame.

The heated and stretched fabric was then subjected to a simulated hot-wet finishing procedure, referred to herein as "mock dyeing" in which the fabric was immersed in 100° C. boiling water for one hour. The amount of stretch remaining in the fabric after the mock dyeing was measured for each sample. After mock dyeing, each sample of the invention had final dimensions that were about the same as the original dimensions of the fabric as woven.

EXAMPLE 1

In this example, fabrics were woven with combination yarn that had a companion yarn consisting of two ends of 95-den (106-dtex), 34-filament, semi-dull 6,6-nylon POY yarn (Type 288 sold by E. I du Pont de Nemours & Co.). The POY yarn had a tenacity at break of 3.4 g/den (3.0 dN/tex) and a break elongation of 67%, and was customarily intended to be drawn to 70 den (78 dtex). The samples were subjected to dry and wet stretching and heating tests at different temperatures and different total mechanical stretch in the direction of the weft combination yarns, as indicated in Table I below. The table also summarizes the amount of stretch in the woven fabric after being removed from the stretcher and after being exposed to mock dyeing. The tests illustrate suitable conditions for obtaining desirable stretch properties in woven fabrics comprising combination yarns that have 66 nylon POY companion yarns. The results with comparative Samples A and B also show that excessive mechanical stretching can result in excessive stretch in the fabric after finishing and dyeing.

TABLE I

| Example 1, 6,6-nylon POY | | | | |
|---|---|---|---|---|
| | Mechanical Stretching | | % Fabric Stretch After | |
| Sample | Temperature | % Stretch | Stretching | Mock dyeing |
| | | Dry Mechanical Stretching | | |
| 1 | 140° C. | 50 | 20 | 27 |
| 2 | 160° C. | 50 | 24 | 25 |
| 3 | 180° C. | 50 | 26 | 25 |
| 4 | 160° C. | 75 | 32 | 36 |
| A | 160° C. | 100 | 42 | 51 |
| | | Wet Mechanical Stretching | | |
| 5 | 140° C. | 50 | 20 | 28 |
| 6 | 160° C. | 50 | 23 | 28 |
| 7 | 180° C. | 50 | 22 | 24 |
| 8 | 160° C. | 75 | 43 | 41 |
| B | 160° C. | 100 | 55 | 70 |

EXAMPLE 2

In this example, fabrics were woven with combination yarn that had a companion yarn consisting of four ends of 55-dtex, 13-filament, semi-dull 6-nylon POY yarn (sold by Nylon de Mexico, S.A., Monterey N.N., Mexico). This POY yarn is customarily intended to be drawn to 44 dtex. The results of the stretching, heating and finishing on the stretch characteristics of the fabrics are summarized in Table II below. The results illustrate the successful use of 6-nylon as a companion yarn for the POY component of the elastic combination weft yarns (Samples 9-13) and the need to avoid excessive stretching of the fabric during processing (comparative Samples C-E).

TABLE II

| Example 2, 6-nylon POY | | | | |
|---|---|---|---|---|
| | Mechanical Stretching | | % Fabric Stretch After | |
| Sample | Temperature | % Stretch | Stretching | Mock dyeing |
| | | Dry Mechanical Stretching | | |
| 9 | 160° C. | 50 | nm | 33 |
| 10 | 180° C. | 50 | nm | 31 |
| C | 160° C. | 100 | nm | 51 |
| | | Wet Mechanical Stretching | | |
| 11 | 140° C. | 50 | 28 | 36 |
| 12 | 160° C. | 50 | 28 | 35 |
| 13 | 180° C. | 50 | 28 | 34 |
| D | 160° C. | 75 | 41 | 60 |
| E | 160° C. | 100 | 60 | 60 |

*nm means no measurement was recorded.

EXAMPLE 3

In this example, fabrics were woven with combination yarn that had a companion yarn consisting of one end of 265-den (294-dtex), 34-filament, semi-dull DACRON® polyester fiber Type 56 POY yarn. This POY yarn was made of poly(ethylene terephthalate) homopolymer and had a tenacity at break of 2.3 g/den (2.0 dtex) and a break elongation of 150%. Usually, this POY yarn is intended to be drawn to 150 den (167 dtex). The results of the stretching, heating and finishing conditions on the stretch characteristics of the fabrics are summarized in Table III below.

TABLE III

| Example 3, polyester homopolymer POY | | | | |
|---|---|---|---|---|
| | Mechanical Stretching | | % Fabric Stretch After | |
| Sample | Temperature | % Stretch | Stretching | Mock dyeing |
| | Dry Mechanical Stretching | | | |
| 14 | 140° C. | 50 | 22 | 38 |
| 15 | 180° C. | 50 | 22 | 37 |
| G | 180° C. | 75 | 35 | 50 |
| H | 180° C. | 100 | 49 | 60 |
| | Wet Mechanical Stretching | | | |
| 16 | 90° C. | 50 | 37 | 18 |
| 17 | 140° C. | 50 | 40 | 21 |
| 18 | 180° C. | 50 | 33 | 18 |
| I | 180° C. | 75 | 52 | 42 |
| J | 180° C. | 100 | 74 | 56 |

EXAMPLE 4

In this example, fabrics were woven with combination yarn that had a companion yarn consisting of one end of 245-den (272-dtex), 34-filament, semi-dull DACRON® polyester fiber Type 92 POY yarn. The POY companion yarn was made of cation dyeable polyester copolymer and had a tenacity at break of 1.3 g/den (1.1 dtex) and a break elongation of 115%. Usually, this POY yarn is intended to be drawn to 150 den (167 dtex). The results of the stretching, heating and finishing conditions on the stretch characteristics of the fabrics are summarized in Table IV below.

TABLE IV

| Example 4, Copolyester POY | | | | |
|---|---|---|---|---|
| | Mechanical Stretching | | % Fabric Stretch After | |
| Sample | Temperature | % Stretch | Stretching | Mock dyeing |
| | Dry Mechanical Stretching | | | |
| K | 140° C. | 50 | 35 | 47 |
| 19 | 180° C. | 50 | 19 | 24 |
| 20 | 160° C. | 100 | 20 | 36 |
| 21 | 140° C. | 75 | 20 | 37 |
| 22 | 160° C. | 75 | 20 | 28 |
| 23 | 180° C. | 75 | 16 | 33 |
| | Wet Mechanical Stretching | | | |
| 24 | 140° C. | 50 | 36 | 16 |
| 25 | 180° C. | 50 | 32 | 24 |
| 26 | 90° C. | 75 | 34 | 18 |
| 27 | 140° C. | 75 | 31 | 16 |
| 28 | 160° C. | 75 | 43 | 16 |
| 29 | 180° C. | 75 | 50 | 28 |
| 30 | 160° C. | 100 | 78 | 36 |

Example 5

This example illustrates the use of a tenter in the process of the invention. The same fabric as was used in Example 3 was stretched while dry on a five-box tenter frame, each box being 10-feet long (sold by Bruckner Machinery of Spartanburg, South Carolina). To achieve sufficient stretching on this short tenter frame (full-size commercial units typically have 8 to 10 boxes, each of 10-foot length), fabrics samples were stretched in two passes with half the total stretch being imposed in each pass. Fabric Sample 31 was stretched a total of 50%, from 48 inches (122 cm) to 72 inches (183 cm) in width). The fabric experienced a temperature of 140° C. for 20 seconds in the first pass and 160° C. for 20 seconds in the second pass. Fabric Sample 32 was stretched a total of 38%, from 48 inches (122 cm) to a 66-inch (168-cm) width, at a temperature of 140° C. for 20 seconds in the first pass and at 180° C. for 15 seconds in the second pass. Each of these fabric samples was allowed to cool while in the stretched condition. As a result of the stretching, the partially oriented companion yarn of the combination yarn became oriented, as could be seen by elongation and tenacity measurements made on companion yarns teased from the fabric. The polyester companion yarn from Sample 31, which had been stretched 50%, had a tenacity at break of 1.7 g/den (1.5 dN/tex) and a break elongation of 15%. The corresponding properties for the polyester companion yarn of Sample 32, which had been stretched 38%, were respectively 1.3 g/den (1.1 dN/tex) and 29%.

The thusly stretched fabrics were then scoured in six passes through an open width washer (sold by Jawatex A.G. Textilmaschinen, Rorschach, Switzerland). The temperature was increased in each subsequent pass. The fabric entered the first pass at a temperature of 140° F. (60° C.) and exited the last pass at 210° F. (99.8° C.).

Fabric stretch was determined by comparing a 20-inch gauge length marked on the woven fabric prior to stretching with the length of the marked gauge length when the final fabric was extended in the POY (weft) direction under a 2-lb/inch (0.36-Kg/cm) load. Before the scouring, neither Sample 31 nor Sample 32 exhibited any fabric stretch. However, after the hot-wet finishing, Samples 31 and 32 respectively exhibited a 33% and 22% fabric stretch. The spandex of the combination yarn was not heat set during the heating and stretching step. The spandex relaxed to its original as-woven dimensions in the finishing step. Thus, all the fabric stretch was developed in the hot-wet finishing step.

I claim:

1. An improved process for preparing a stretch woven fabric which includes the steps of weaving a fabric with warp yarns and weft yarns, at least the warp yarns or the weft yarns being combination yarns which comprise an elastomeric strand and a non-elastomeric companion yarn, and then stretching, heat setting, and finishing the woven fabric, wherein the improvement comprises the non-elastomeric companion yarn being of partially molecularly oriented synthetic organic polymer and the elastic strand having a heat setting temperature that is higher than the heat setting temperature of the non-elastomeric companion yarn, stretching the woven fabric by 25 to 85% in the direction of at least the warp combination yarns or the weft combination yarns, heat treating the stretched woven fabric, while in the stretched condition for 30 to 90 seconds at a temperature in the range of 80° to 180° C., said temperature being below the heat setting temperature of the elastomeric strand, and finishing the heat-treated fabric in an aqueous bath for at least ½ hour at temperature that is no higher than 135° C.

2. A process in accordance with claim 1 wherein the woven fabric is stretched by 50 to 75% in the direction of the combination yarn[,] and the heat treatment is performed at a temperature of at least 120° C. for 45 to 60 seconds.

3. A process in accordance with claim 1 or 2 wherein the elastomeric strand of the combination yarn is spandex.

4. A process in accordance with claim 3 wherein the partially molecularly oriented synthetic organic polymer of the companion yarn is of polyester or nylon.

* * * * *